US008516717B2

(12) United States Patent
Bonilla-Espada

(10) Patent No.: US 8,516,717 B2
(45) Date of Patent: Aug. 27, 2013

(54) HIGH-HEELED BIFUNCTIONAL POINTE SHOE

(75) Inventor: Dorimar Bonilla-Espada, Las Vegas, NV (US)

(73) Assignee: Dorimar Bonilla-Espada, Cayey, PR (US)

( * ) Notice: Subject to any disclaimer, the term of this patent is extended or adjusted under 35 U.S.C. 154(b) by 443 days.

(21) Appl. No.: 12/646,984

(22) Filed: Dec. 24, 2009

(65) Prior Publication Data

US 2011/0154687 A1 Jun. 30, 2011

(51) Int. Cl.
*A43B 5/12* (2006.01)

(52) U.S. Cl.
USPC ..... 36/8.3; 36/103; 36/24.5

(58) Field of Classification Search
USPC ..... 36/8.3, 25 R, 76 R, 77 R, 24.5, 103
See application file for complete search history.

(56) References Cited

U.S. PATENT DOCUMENTS

| | | | | |
|---|---|---|---|---|
| 1,553,196 | A * | 9/1925 | Solomonoff | 36/8.3 |
| 5,996,251 | A * | 12/1999 | LaDuca | 36/8.3 |
| 6,151,800 | A * | 11/2000 | Kerr et al. | 36/8.3 |
| 6,857,203 | B2 * | 2/2005 | Minden | 36/8.3 |
| 2002/0078591 | A1 * | 6/2002 | Morrone | 36/8.3 |
| 2004/0216328 | A1 * | 11/2004 | LaDuca | 36/8.3 |
| 2006/0174512 | A1 * | 8/2006 | LaDuca | 36/8.3 |
| 2008/0086906 | A1 * | 4/2008 | Wilkenfeld | 36/8.3 |
| 2008/0086912 | A1 * | 4/2008 | Wilkenfeld | 36/92 |
| 2008/0168680 | A1 * | 7/2008 | Ransan | 36/8.3 |

* cited by examiner

*Primary Examiner* — Marie Patterson

(57) ABSTRACT

The present invention is a bifunctional, high-heeled dancer's shoe with the flexibility and strength to allow the dancer to go from standing on the heel to an on pointe position (standing on the toes). The shoe has the capacity to adjust, in order to provide the dancer the ability to combine dance moves from multiple dance styles with ballet. The shoe is composed of a hard front toe box, a half front shank attached to the front box that thins out in the middle of the foot, a partial metal shank that extends from the back of the shoe into the arch, a plastic high heel, a leather outer sole, and a closed satin and fabric body with an adjustable elastic thread on the top of the foot.

4 Claims, 8 Drawing Sheets

HIGH-HEELED BIFUNCTIONAL POINTE SHOE

CROSS-REFERENCE TO RELATED APPLICATIONS

Not applicable.

BACKGROUND OF THE INVENTION

1. Field of the Invention

Ballet technique is essential to develop other dance styles, yet dance shoes for each other style limit the presence of ballet by not providing the dancer with the tools needed to perform several classical ballet moves. A bifunctional shoe allows the dancer to develop a higher level of technique by not being limited to one specific style.

Most dancers start their training background in classical ballet as they develop other techniques from various dance styles in order to be able to perform at a professional level. There has never been a shoe that specifically allows the dancer to integrate moves from classical ballet into modern styles in their performances.

2. Description of the Related Art

A classical ballet shoe doesn't provide the dancer with enough flexibility versatility to perform dance moves from various other dance styles. A character or ballroom shoe doesn't provide the dancer enough strength to stand on the toes and perform moves from classical ballet.

Performances at a professional level are more demanding nowadays, in regard to level of technique and appearance. A classic pointe shoe does not provide the sophisticated feminine look that today's shows require. Ballroom and character shoes don't allow for a high level of classical technique.

A bifunctional dance shoe with a specially designed sole that allows a fully functional toe box and a high heel to be integrated into the same shoe is a significant advance in technology, not existing in prior art.

SUMMARY OF THE PRESENT INVENTION

In brief summary, the dance shoe of the present invention is a bifunctional shoe with a specially designed split sole that combines a ballet toe box with a high heel. It provides flexibility and strength to allow the dancer to go from standing on the heel to an en pointe position. Its unique construction allows the dancer to combine moves from multiple dance styles with classical ballet. The shoe is composed of a hard front toe box, a half front shank attached to the front box that thins out in the middle of the foot, a partial metal shank that extends from the back of the shoe into the arch, a plastic high heel, a leather outer sole, and a closed satin and fabric body with an adjustable elastic thread on the top of the foot.

OBJECTS OF THE INVENTION

To provide a toe shoe with the flexibility needed to perform moves not limited to classical ballet.

To provide a high heeled dance shoe with the strength to go to an en pointe position.

To provide a shoe that provides a toe box for classical ballet moves with the look that professional modern shows require.

To provide a shoe that allows a dancer to multi-task and perform more than one dance style at once.

To provide a shoe that allows a dancer to develop a higher level of technique in various dance styles at once.

To provide a shoe that is facilitates comfortable, smooth transitions between foot positions from various dance techniques.

DETAILED DESCRIPTION OF THE PREFERRED EMBODIMENTS

Figure 6:
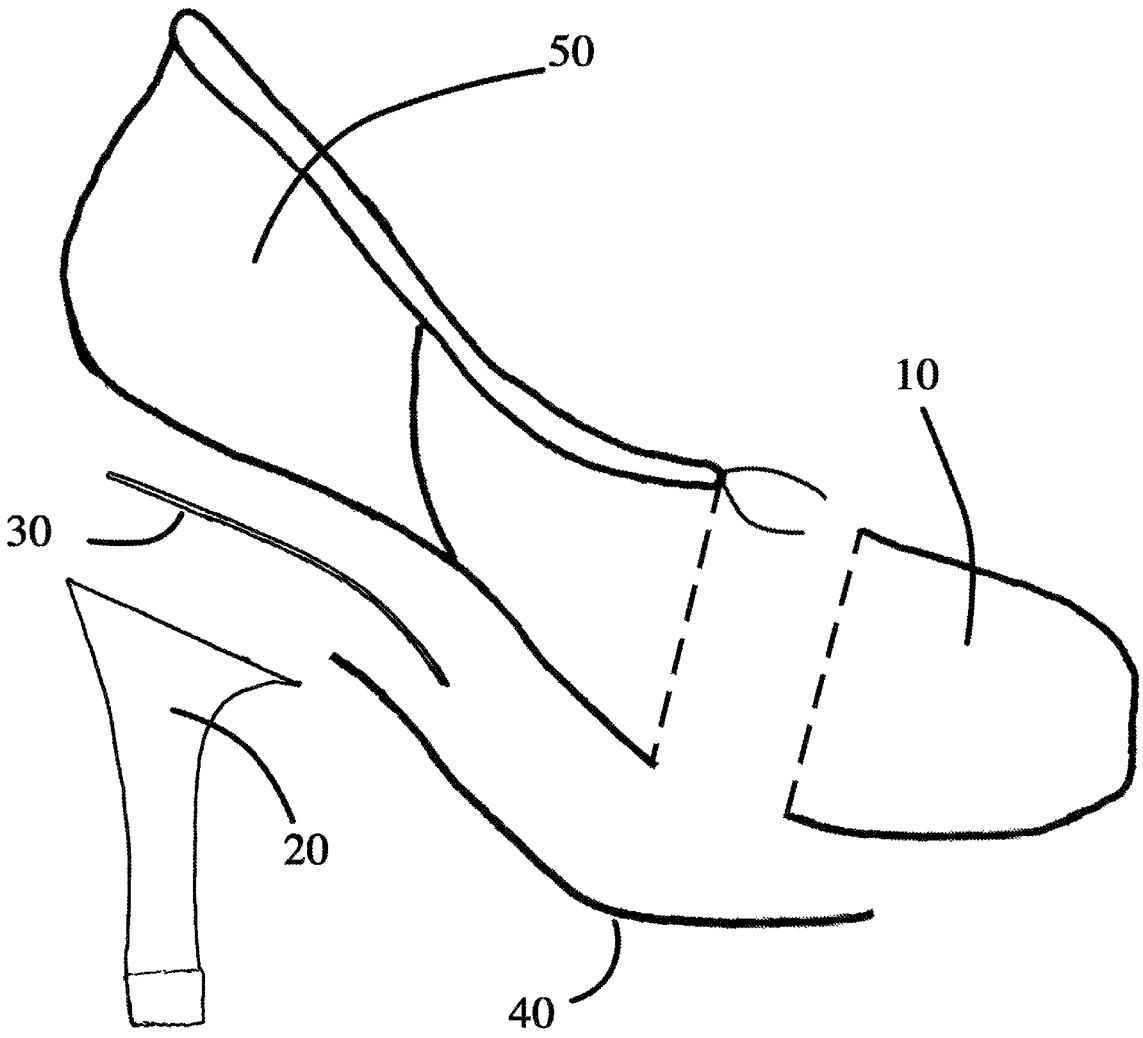
FIG. 6 is an exploded side view of the current present invention.
Figure 7:
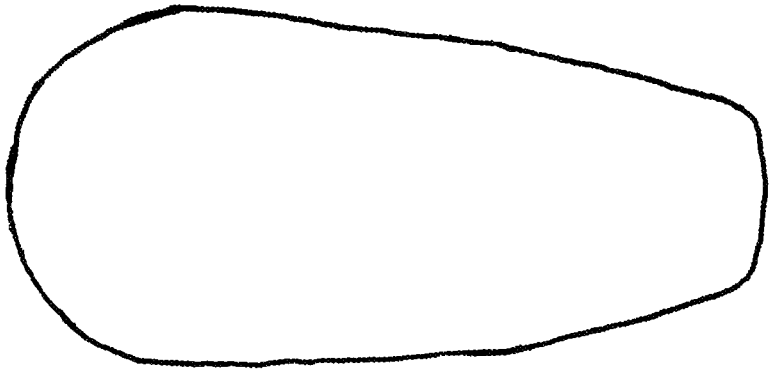
FIG. 7 is a top perspective view of the half shank.
Figure 8:
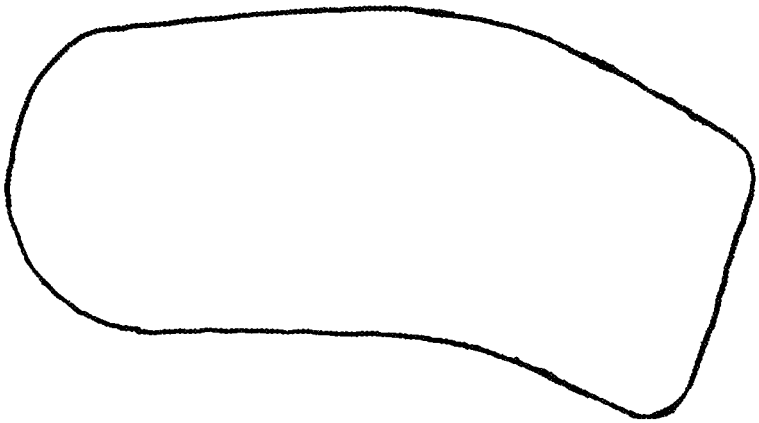
FIG. 8 is a three-quarter perspective view of the half shank.

FIG. 6 shows the unassembled elements of the shoe from a side view. The shoe contains a toe box (10), a partial metal shank (30), an outer sole (40), a heel (20) and a shoe upper (50).

The toe box (10) is a fully functional rigid box that covers the toes and ball of the foot. While being rigid enough to allow the dancer to stand on the toes, it is separated from the partial metal shank in order to allow the dancer to flex the foot.

The partial metal shank (30) is a rigid half shank that offers strength to stand on the high heel. It extends forward from a back of the shoe above a face of the heel and further extending forward over the arch in a middle portion of the shoe and terminating more or less where the arch of the foot ends. While it offers support on the heel it allows movement of the foot from a flexed to a pointed position. This shank is usually made of metal, but it could also be made of a choice of various other non-metal materials, as long as it provides the strength and support needed.

The heel (20) is made of hard plastic and covered by satin and fabric. It varies in height between two and four inches.

The outer sole (40) is a continuous layer of leather spanning the length of the shoe. It connects the heel, half shank and front toe box. This outer sole is flexible and allows movement of the foot.

The shoe upper (50) is a dosed satin shoe body shaped for receiving the dancer's foot, said shoe upper covers the front toe box, and comprises an adjustable elastic that hugs around the back of the heel extending towards the top of the front of the foot. This shoe upper is soft and flexible to provide the dancer comfort and flexibility, and allows easy movement of the foot. A spandex material can be added in the form of a heel cup, or can be used to replace satin fabric around the heel area, to adjust the fit.

Figure 1:
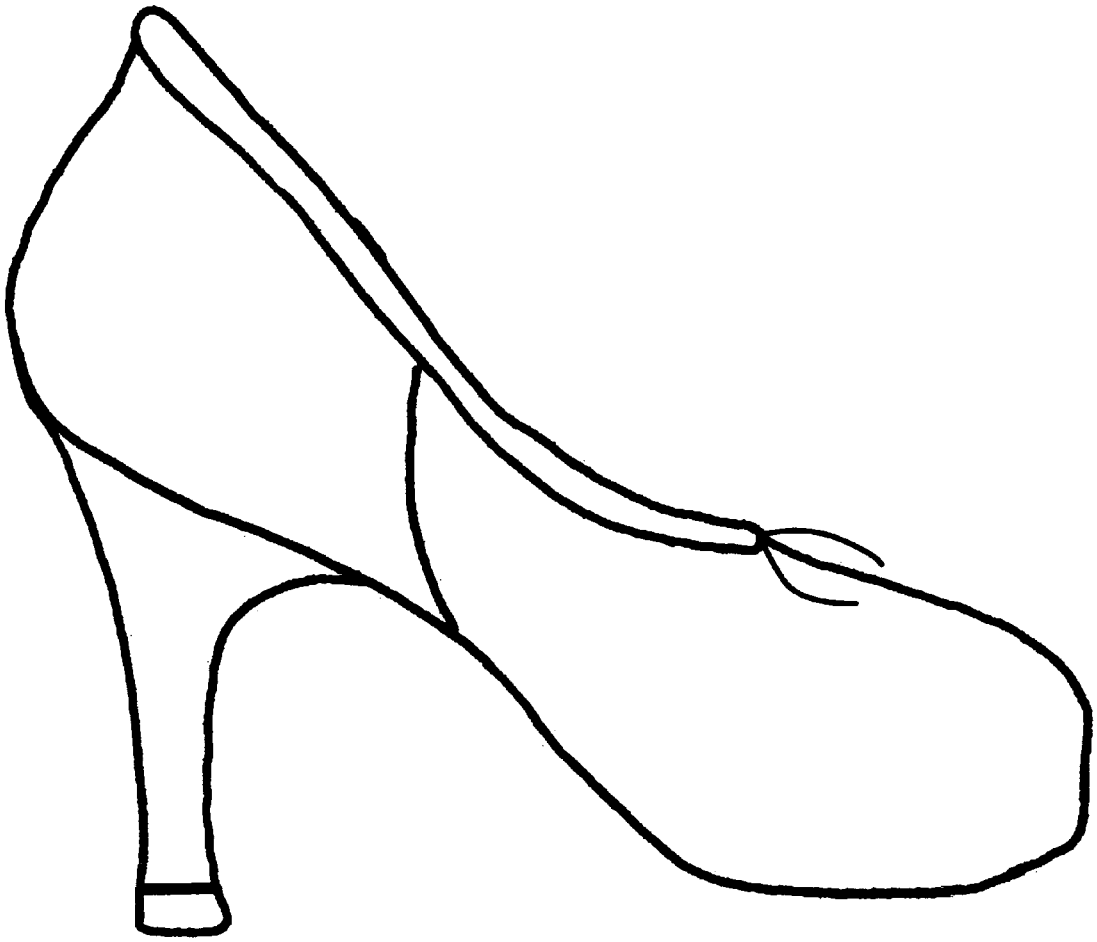
FIG. 1 is a side view of the present invention in a flexed position.
Figure 2:
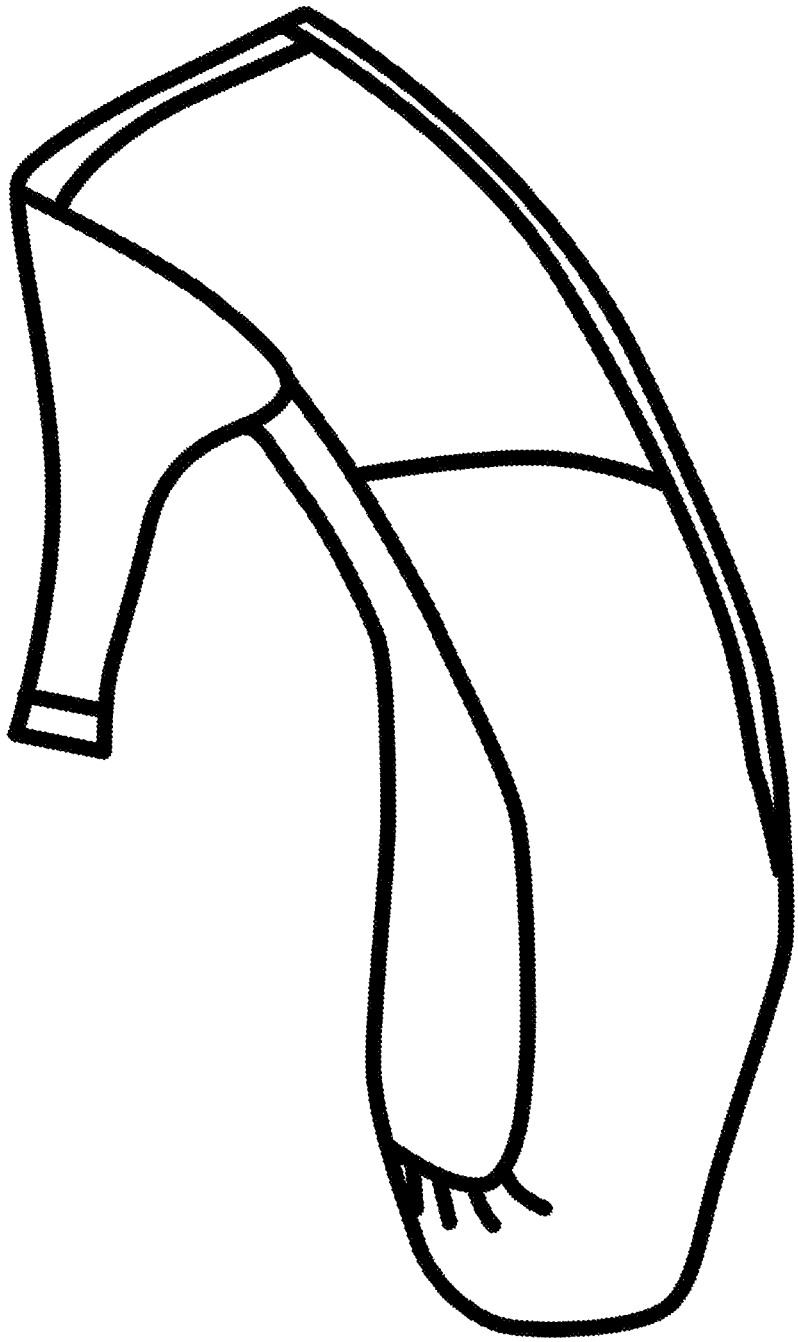
FIG. 2 is a side perspective view of the present invention in an en pointe position
Figure 3:
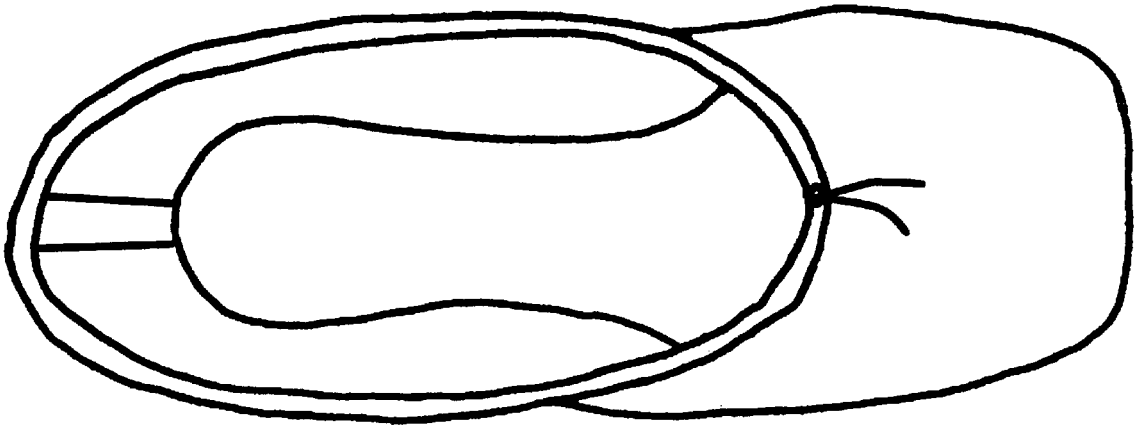
FIG. 3 is a top perspective view of the present invention.
Figure 4:
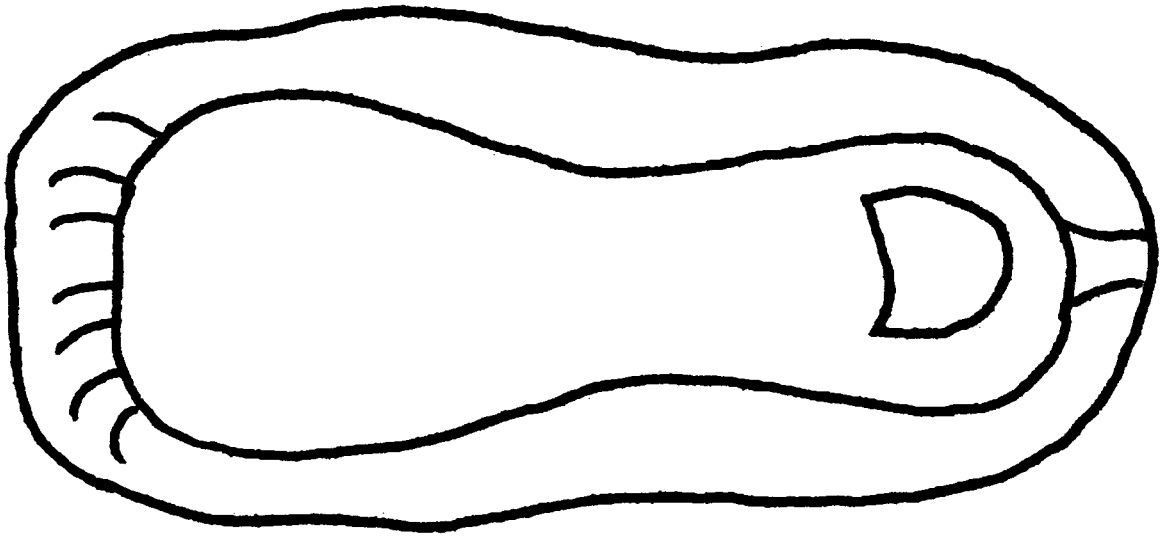
FIG. 4 is a bottom view of the present invention.
Figure 5:
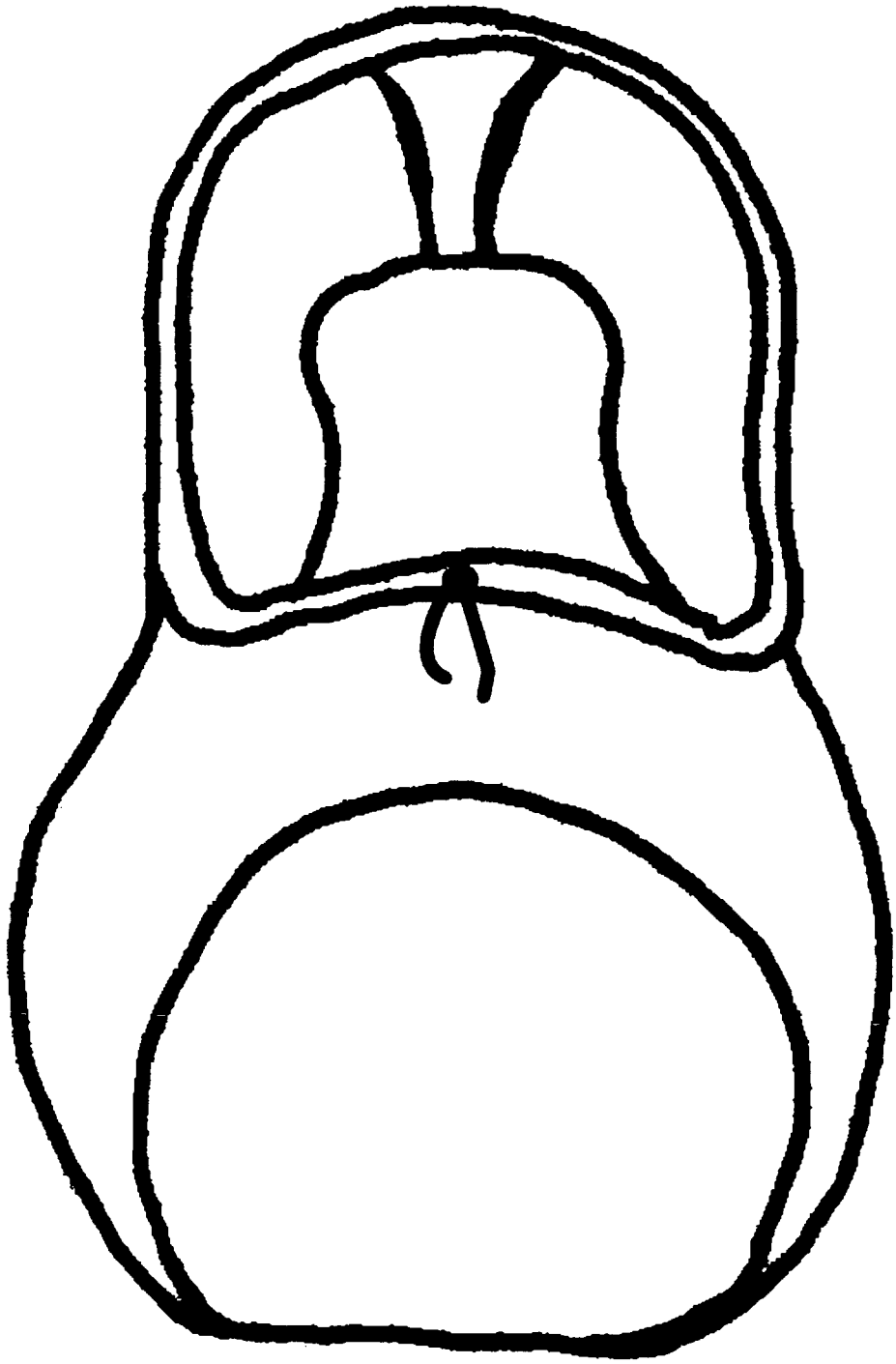
FIG. 5 is a front perspective view of the current invention.

FIGS. 1 & 2 show the shoe in a flexed and en pointe position, respectively, from a side view. The shoe should be flexible enough to allow this movement and strong enough to support the dancer standing on either one of these positions.

Additional inner sole (not shown) is optional in different soft materials to provide extra comfort and cushion the foot, as well as a spandex heel cup above the back of the shank (30) and top of the heel (20), for extra support and for tighter fit. Cushioning for the toes inside the toe box can be added as well in different types of materials for various levels of comfort.

Accessories like elastic, ribbons, or straps (not shown) can be added to the satin upper of the shoe (50), as it is standard for ballet dancers to add some of these in toe shoes to keep them secured to the foot and to provide ankle support. Such accessories can be placed in different areas, depending on the dancer's personal preference or needs.

Additional attachments to the outer sole (40) such as rubber or other non-slip materials can be added for safety. These additions are optional, based on the needs for a dancer's performance and/or training, the material of the surface where such performance and/or training will take place, or a dancer's personal preference.

It will be understood by those skilled in shoe making that the mentioned optional additions, as well as other aspects of the shoe that have been omitted for clarity, would be obvious to a practitioner building the shoe from these specifications.

It will be understood that other natural or artificial non-leather materials, such as, but not limited to, vinyl plastic, could be used to replace the leather outer sole.

It will be also understood that the specifications above, even though they are detailed in description and illustration of the apparatus, are not meant to limit the invention to a specific exact construction. It is to be understood that the descriptions above illustrate the principles of the invention, and various other modifications and changes can be made by those skilled in the art. It is not intended to limit the invention to the construction described or illustrated. It is intended that the scope of the invention be limited not by this detailed description, but rather by the claims appended hereto.

The invention claimed is:

1. A dancer's shoe with a specially designed sole that combines a high heel and a hard toe box, comprising: a high heel, said heel being plastic and at least two inches in height, a toe box, said toe box being hard, non flexible, with a squared like shape and a flat tip to allow balancing on the tip of the toes (en pointe): a closed shoe body made of satin and lined with cloth fabric, said upper covering the front toe box and extended under the feet to become part of the sole; a curved partial metal shank that holds the high heel and ends before the toe box begins: and a partial, thin, flexible outer sole that does not cover the entire bottom of the shoe, but serves as a connector between the parts above mentioned, allowing movement and enough flexibility to easily point or flex the feet.

2. The dancer's shoe of claim 1, wherein the heel is between approximately 2 and 4 inches in height.

3. The dancers shoe of claim 1, wherein the partial thin leather outer sole extends in the form of a strip from the heel through the arch and ends before it reaches the front of the toe box, connecting the parts above mentioned, and it's not wide enough to reach the sides of the shoe, allowing the satin body to partially share the bottom of the shoe.

4. The dancer's shoe of claim 1, wherein the closed shoe body contains an adjustable elastic thread that hugs around the foot.

* * * * *